US006976436B1

(12) United States Patent
Sugihara et al.

(10) Patent No.: US 6,976,436 B1
(45) Date of Patent: Dec. 20, 2005

(54) SYNTHETIC RESIN PALLET

(75) Inventors: Junro Sugihara, Tokyo (JP); Kiyoshi Kurosawa, Sayama (JP); Tomoyuki Dobashi, Ueda (JP); Soshi Yamamoto, Koshigaya (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 375 days.

(21) Appl. No.: 10/343,837

(22) PCT Filed: Sep. 25, 2000

(86) PCT No.: PCT/JP00/06568

§ 371 (c)(1),
(2), (4) Date: Feb. 11, 2003

(87) PCT Pub. No.: WO02/18218

PCT Pub. Date: Mar. 7, 2002

(30) Foreign Application Priority Data

Aug. 29, 2000 (JP) ..... 2000-258925

(51) Int. Cl.[7] ..... B65D 19/38
(52) U.S. Cl. ..... 108/57.25
(58) Field of Search ..... 108/51.11, 53.1, 108/53.3, 53.5, 54.1, 56.3, 56.1, 57.25, 901, 108/902; 248/346.02

(56) References Cited

U.S. PATENT DOCUMENTS 2,447,542 A * 8/1948 Seward ..... 108/53.3
3,526,195 A * 9/1970 Maryonovich ..... 108/53.1
3,610,172 A * 10/1971 Wharton ..... 108/53.3
3,680,495 A * 8/1972 Pike ..... 108/53.3
3,964,400 A * 6/1976 Brand ..... 108/57.25
4,183,491 A * 1/1980 Sanders et al. ..... 248/346.02
4,279,204 A * 7/1981 Propst ..... 108/53.3
4,619,207 A * 10/1986 Boyce et al. ..... 108/53.3
5,408,937 A * 4/1995 Knight et al. ..... 108/53.3
6,029,583 A * 2/2000 LeTrudet ..... 108/57.25
6,357,366 B1 * 3/2002 Frankenberg ..... 108/57.25
6,446,563 B1 * 9/2002 Ohanesian ..... 108/57.25

FOREIGN PATENT DOCUMENTS

| | | |
|---|---|---|
| GB | 1005589 | 9/1965 |
| JP | 9-267838 | 10/1997 |
| JP | 9-323727 | 12/1997 |
| JP | 11-236040 | 8/1999 |

* cited by examiner

*Primary Examiner*—Jose V. Chen
(74) *Attorney, Agent, or Firm*—Armstrong, Kratz, Quintos, Hanson & Brooks, LLP

(57) ABSTRACT

This synthetic resin pallet has a load portion 1 and a plurality of leg portions 2 protruding downward from the load portion 1 with fork inserting portions 4 provided between the leg portions 2. The load portion 1 comprises a horizontal plate portion and a grating portion 6 formed by intersection of a plurality of vertical ribs 6*a*, 7*a* and a plurality of horizontal ribs 6*b*, 7*b*, provided at a bottom of the horizontal plate portion. The leg portions 2 are so formed as to protrude downward from a lower end of the grating portion 6. Each of the leg portions 2 comprises a plurality of small leg portions 3 that are separated by a plurality of parallel vertical ribs 7*a* and/or a plurality of parallel horizontal ribs 7*b*. Engagement holes 22 are formed in the small leg portions 3 and plate-like link portions 20 are attached by fitting engagement portions 24 in the engagement holes. Recesses in which the small leg portions 3 are to be fitted are formed in the plate-like link portions 20.

9 Claims, 9 Drawing Sheets

SYNTHETIC RESIN PALLET

TECHNICAL FIELD

The present invention relates to a synthetic resin pallet that is used in transporting various articles.

BACKGROUND ART

Conventionally, a synthetic resin pallet that has a load portion on which articles are loaded and a plurality of leg portions extending downward from the load portion with fork inserting portions provided between the leg portions is used at the time of transporting various articles.

In the case where such synthetic resin pallets having articles placed thereon were stacked one on another, the leg portions of a synthetic resin pallet would hit the articles of the underlying pallet, thus breaking the articles of the underlying pallet.

When such synthetic resin pallets having articles placed thereon were moved on a roller conveyor, undesirable vibration could occur, thus causing load collapsing.

Japanese Patent Application, First Publication No. Hei 11-236040 has proposed a synthetic resin pallet that comprises a synthetic resin pallet body having leg portions and a plurality of plate-like link portions, which are detachably attached to the leg portions of this synthetic resin pallet body to links of a plurality of leg portions. According to this synthetic resin pallet, engagement portions are formed on the bottom surfaces of bottomed hollow leg portions of the pallet body, so that the plate-like link portions are fixed to the leg portions of the pallet body merely by engaging those engagement portions with engagement portions formed on the plate-like link portions.

With the engaging mechanism that secures the plate-like link portions only with the engagement portions provided on the bottom surfaces of the leg portions, when a loading worker, however, moved the pallet dragging on the floor, shearing force would be applied to the fitting section depending on the moving direction, so that the plate-like link portions would often come off carelessly, thus obstructing the loading work, which was inconvenient.

While such a synthetic resin pallet body has an advantage that the bottomed hollow structure of the leg portions and the sheet-like load portion can suppress the stacking height low at the time multiple pallet bodies are piled up, the sheet-like load portion, if loaded with a load and lifted up by a forklift or the like, is apt to bend, which is likely to collapse or damage the load.

As a solution to such an insufficient strength, Japanese Patent Application, First Publication No. Hei 11-35039 has proposed a structure which has reinforced ribs formed at the bottom surfaces of the load portion of a pallet body so that adjoining leg portions are linked together by the reinforced ribs. Even this structure does not provide a sufficient strength to handle heavy articles.

DISCLOSURE OF INVENTION

It is a first object of the present invention to provide a synthetic resin pallet having a sufficient strength. It is a second object of this invention to provide a synthetic resin pallet which has sufficient fitting force to prevent plate-like link portions from inadvertently coming off during loading even when the pallet on a floor is shifted back and forth and right and left with the plate-like link portions attached to the leg portions of the pallet body.

A synthetic resin pallet of this invention has a load portion and a plurality of leg portions protruding downward from the load portion with fork inserting portions provided between the leg portions. The load portion comprises a horizontal plate portion and a grating portion formed by intersection of a plurality of vertical ribs extending vertically and a plurality of horizontal ribs extending horizontally, provided at a bottom of the horizontal plate portion, and the leg portions are so formed as to protrude downward from a lower end of the grating portion.

According to this synthetic resin pallet, the grating portion is formed by the intersection of a plurality of vertical ribs extending vertically and a plurality of horizontal ribs extending horizontally, so that the bending strength of the horizontal plate portion can be improved.

When each leg portion comprises a plurality of small leg portions which are separated by a plurality of parallel vertical ribs which crosses the leg portions and/or a plurality of parallel horizontal ribs which crosses the leg portions, the strength of the portion around the leg portion can also be improved.

In particular, when each leg portion comprises a plurality of small leg portions between which a plurality of parallel vertical ribs that crosses the leg portions, formed at an interval narrower than an interval of the vertical ribs that are not crossing the leg portions, and/or a plurality of parallel horizontal ribs that crosses the leg portions, formed at an interval narrower than an interval of the plural horizontal ribs that are not crossing the leg portions, are formed, the strength of the pallet can be improved further.

In this case, it is desirable that the number of the parallel vertical ribs and/or the parallel horizontal ribs that are formed between the small leg portions should be two to four from the viewpoint of a sufficient strength and easy molding.

Engagement portion inserting holes may be formed in the leg portions or the small leg portions of the synthetic resin pallet so that protruding fitting portions provided on the plate-like link portions are detachably fitted in those engagement portion inserting holes.

In the case where multiple synthetic resin pallets are piled up for storage and safekeeping, it is preferable that the leg portions or the small leg portions are hollow with bottoms, and it is particularly preferable that they become wider upward.

This structure allows a plurality of leg portions (small leg portions) of synthetic resin pallets to be stacked to be easily inserted inside the leg portions (small leg portions) of the synthetic resin pallets to be stacked.

Further, the horizontal plate portion of the load portion may be formed in a grating form along the upper edges of the small leg portions. In this case, even when articles are placed directly on the leg portions, a large area of abutment of the horizontal plate portion and articles can be secured, making it possible to reduce the shortcoming of damaging the loading surface portion of the bottommost article by the weights of the piled articles.

To improve the strength of the load portion, it is preferable that a perpendicular portion extending downward should be formed around the load portion, a plurality of inclined ribs having bottom sides inclined downward should be formed between those vertical ribs and horizontal ribs which extend in parallel along inside the perpendicular portion, and the inclined bottom sides of the inclined ribs should be exposed sideways above the fork inserting portions.

It is preferable that the synthetic resin pallet of this invention should have leg portions so provided as to protrude downward from corner positions of the load portion, intermediate leg portions so provided as to protrude downward from intermediate positions of the periphery of the load portion, and center leg portions so provided as to protrude downward from the center portion of the load portion.

The synthetic resin pallet of this invention may comprise plate-like link portions for linking the individual leg portions. In this case, it is preferable that fitting portions that engage with one another should be formed in the bottom portions of some of the small leg portions and the plate-like link portions. Recesses in which lower ends of the small leg portions are to be fitted are formed in the plate-like link portions as the fitting portions of the plate-like link portions.

When such synthetic resin pallets on which articles are placed are piled up, it is possible to prevent the leg portions from hitting articles of a lower pallet. Even in the case where the pallet on which articles are placed is moved on a roller conveyor, vibration is unlikely to occur so that a high conveying stability can be ensured.

BEST MODE FOR CARRYING OUT THE INVENTION

Preferred embodiments of a synthetic resin pallet according to the present invention will be described below with reference to the accompanying drawings. It is to be noted that this invention is not limited to the following individual embodiments, but, for example, the constituting elements of those embodiments may be combined adequately.

Figure 1:
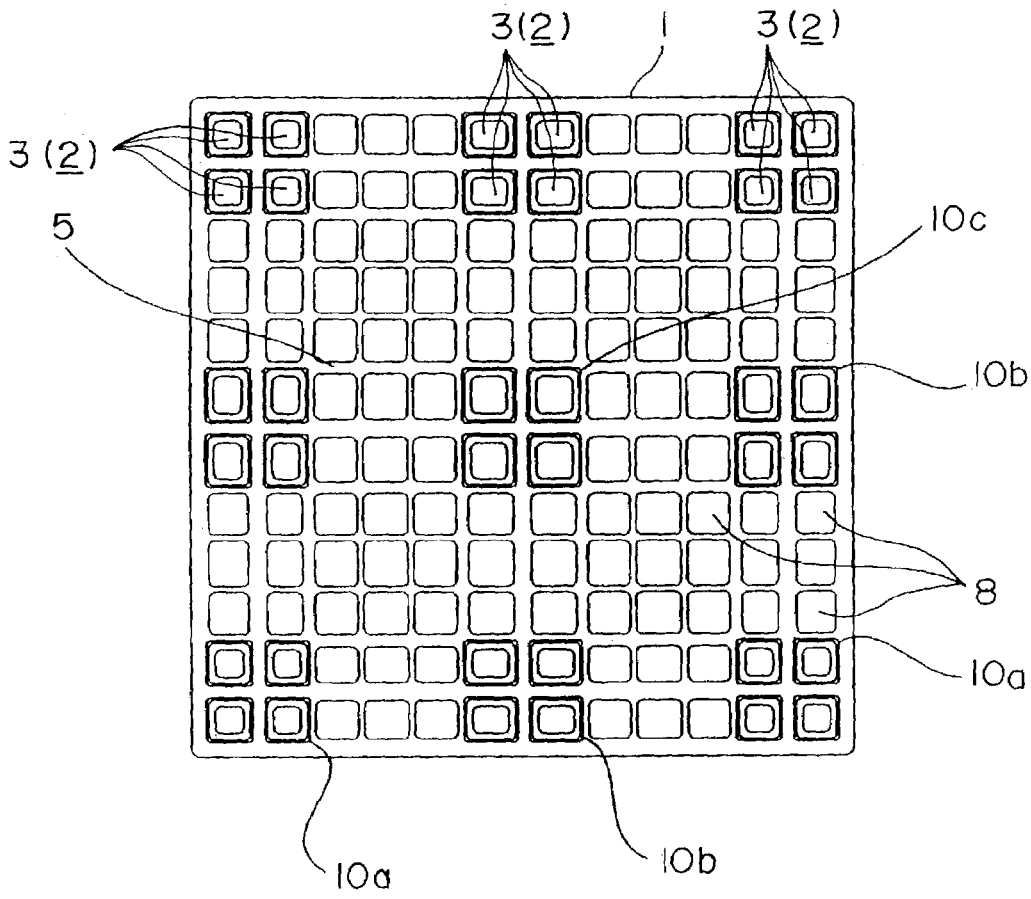
FIG. 1 is a plan view illustrating a first embodiment of a synthetic resin pallet of the present invention.
Figure 2:
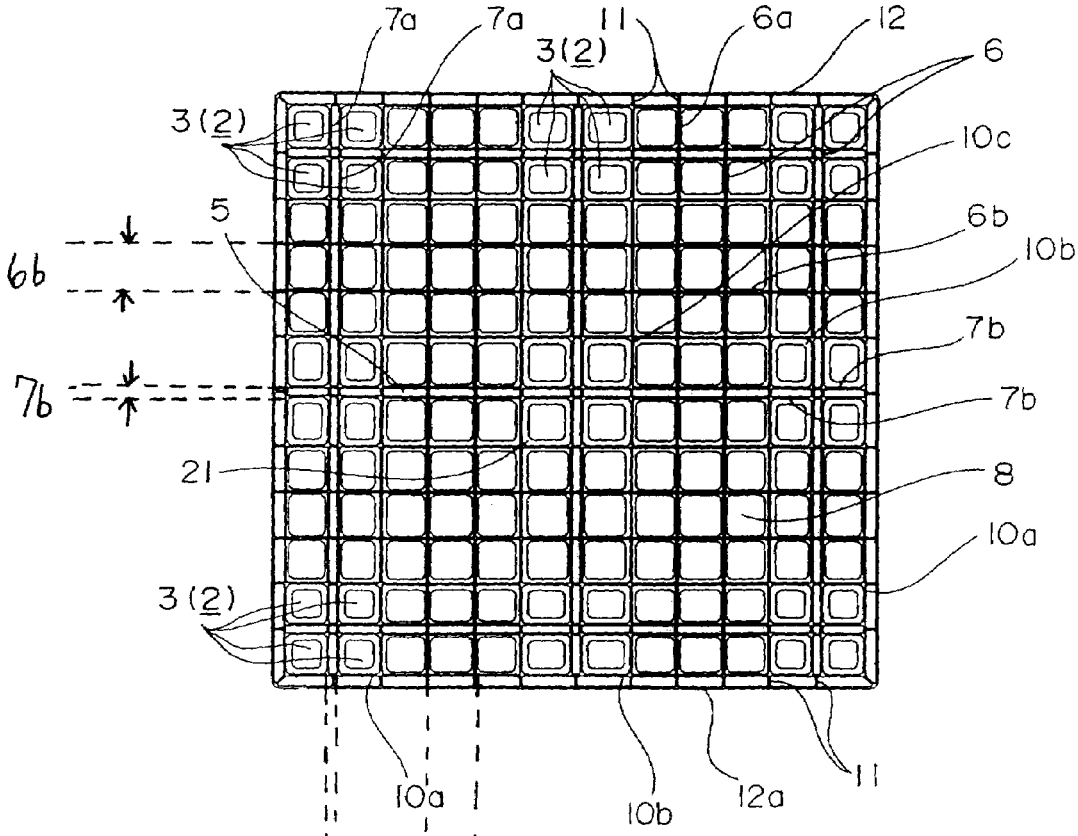
FIG. 2 is a bottom view of the synthetic resin pallet shown in FIG. 1.
Figure 3:
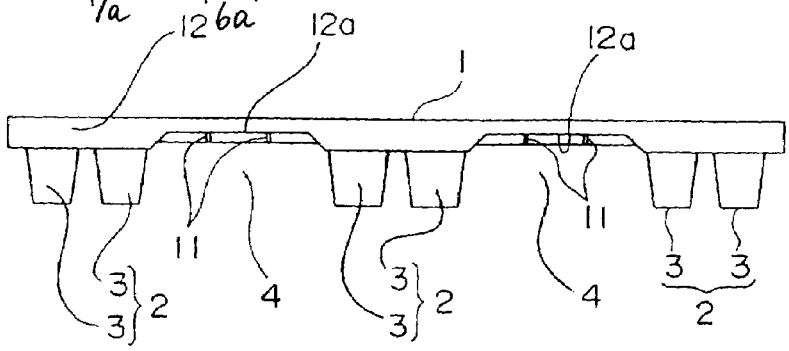
FIG. 3 is a front view of the synthetic resin pallet shown in FIG. 1.
Figure 4:
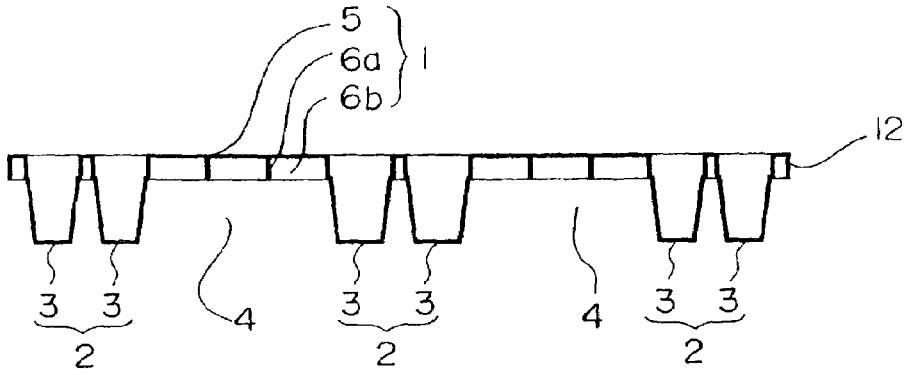
FIG. 4 is a cross-sectional view of the synthetic resin pallet shown in FIG. 1.
Figure 5:
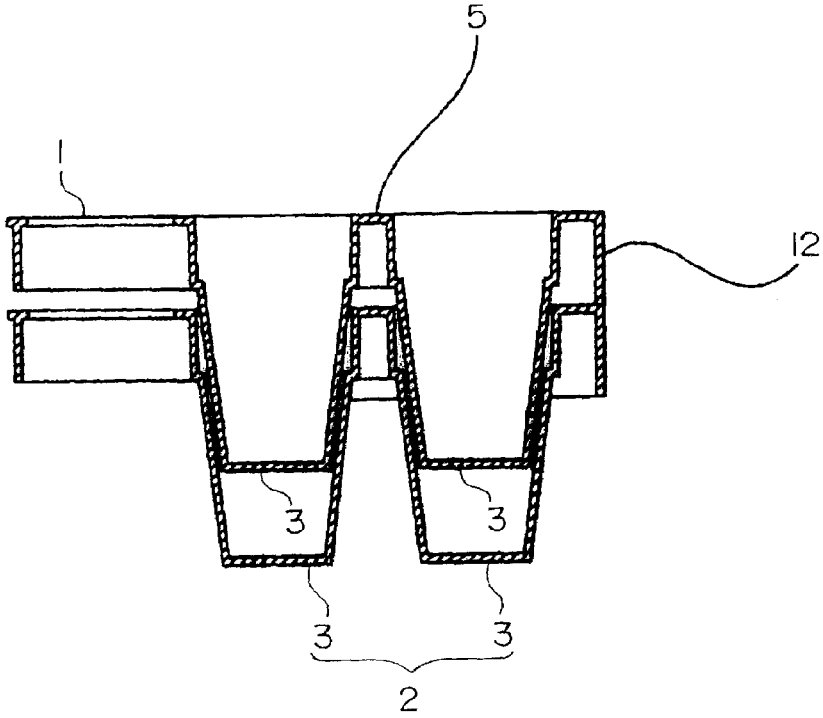
FIGS. 5 and 6 are partially cross-sectional views of the synthetic resin pallets shown in FIG. 1 stacked.

FIGS. 1 through 6 illustrate a synthetic resin pallet according to a first embodiment of this invention, and this synthetic resin pallet has a load portion 1 on which articles are to be placed, and a plurality of (nine in this embodiment) leg portions 2 protruding downward from the load portion 1. Each leg portion 2 is constituted by a plurality of (four in this embodiment) small leg portions 3. As shown in FIGS. 3 and 4, fork-inserting portions 4 are formed between the leg portions 2.

The load portion 1 comprises a horizontal plate portion 5, which constitutes a loading surface, and a grating portion 6 (see FIG. 2) integrally formed at the bottom side of the horizontal plate portion 5. The grating portion 6 is formed by the intersection of a plurality of vertical ribs 6*a*, 7*a* extending vertically and a plurality of horizontal ribs 6*b*, 7*b* extending horizontally, provided at the bottom of the horizontal plate portion 5. Each small leg portion 3 is so formed as to protrude downward from the lower end of the grating portion 6.

Rectangular holes 8 are formed in the horizontal plate portion 5 in areas that are surrounded by the vertical ribs 6*a*, 7*a* and the horizontal ribs 6*b*, 7*b*, excluding the areas where the small leg portions 3 are formed. All the vertical ribs 6*a*, 7*a* and the horizontal ribs 6*b*, 7*b* protrude downward from the horizontal plate portion 5. Although the dimensions of the vertical ribs 6*a*, 7*a* and the horizontal ribs 6*b*, 7*b* are not limited, it is preferable that the width should be 3 to 15 mm and the height should be 30 to 50 mm. It is also preferable that the intervals between the vertical ribs 6*a* and the intervals between the horizontal ribs 6*b* be 20 to 100 mm.

As shown in FIGS. 1 and 2, the leg portions 2 in this embodiment are formed at four corner positions 10*a* of the load portion 1, individual intermediate positions 10*b* of four sides of the load portion 1 and a center position 10*c* of the load portion 1.

The leg portion 2 in this embodiment is comprised of a plurality of (four in this embodiment) small leg portions 3 which are separated by a plurality of (two in this embodiment) parallel vertical ribs 7*a* and a plurality of (two in this embodiment) parallel horizontal ribs 7*b*. Although the numbers of the vertical ribs 7*a* and the horizontal ribs 7*b* that cross between a pair of small leg portions 3 are not limited, they are normally set to two to four and preferably to two. It is preferable that the intervals between the vertical ribs 7*a* and the intervals between the horizontal ribs 7*b* should be respectively narrower than the intervals between the vertical ribs 6*a* and the intervals between the horizontal ribs 6*b*, and although their values are not limited, it is preferable that they should be between 10 to 50 mm. It is preferable that the small leg portions 3 should be rectangular cylinders with bottoms that are tapered to become wider upward.

Figure 6:
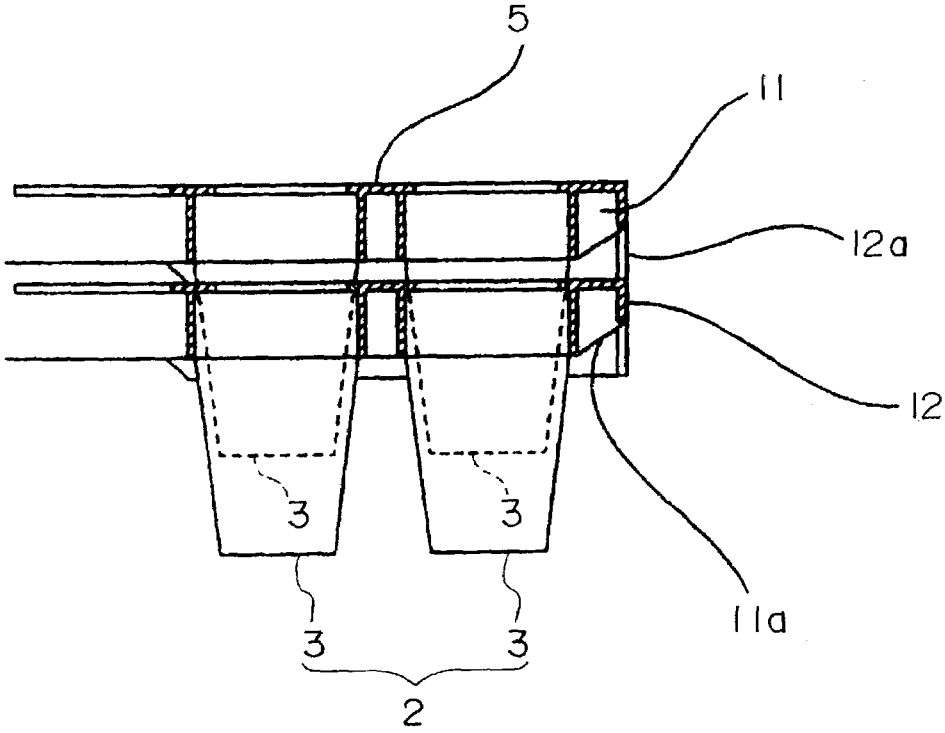

A perpendicular portion 12 extending downward is formed around the load portion 1. A plurality of inclined ribs 11 are formed between the perpendicular portion 12 and those vertical ribs 6*a* or horizontal ribs that extend in parallel along inside the perpendicular portion 12. Lower sides 11*a* of those inclined ribs 11 are inclined downward toward the vertical ribs 6*a* or the horizontal ribs 6*b* from the perpendicular portion 12, as shown in FIG. 6.

As shown in FIG. 3, cutaway portions 12*a* are formed in the lower end of the perpendicular portion 12 at positions corresponding to the fork inserting portions 4. This causes the inclined sides 11*a* of the inclined ribs 11 to be exposed sideways above the fork inserting portions 4.

As the grating portion 6 is formed on the load portion 1 by the intersection of a plurality of vertical ribs 6*a*, 7*a* extending vertically and a plurality of horizontal ribs 6*b*, 7*b* extending horizontally, this synthetic resin pallet has a large strength with respect to a load from the above.

According to this synthetic resin pallet, because each leg portion 2 is comprised of a plurality of small leg portions 3 which are separated by a plurality of parallel vertical ribs 7*a* having narrow intervals and a plurality of parallel horizontal ribs 7*b* having narrow intervals, it is possible to prevent the leg portions 2 from being deformed by the load from the above and the leg portions 2 have a large strength with respect to the load from the above.

As the vertical ribs 7*a* and horizontal ribs 7*b* cross the leg portions 2 and cross the fork inserting portions 4 too, and are linearly continuous over nearly the entire width of the pallet, the linear continuity will not be lost by the presence of the leg portions 2. It is therefore possible to significantly the bending of the pallet at the time of transporting articles by a forklift, thereby preventing the pallet from being damaged and articles from being fallen off.

Because the small leg portions 3 of the pallet of this embodiment are tapered to become wider upward, multiple pallets can be piled up by inserting the small leg portions 3 inside the small leg portions 3, thus making it possible to reduce the volume at the time the pallets are piled up for storage.

According to the pallet of this embodiment, the perpendicular portion 12 extending downward from the periphery of the load portion 1 is formed, a plurality of inclined ribs 11 are formed between the perpendicular portion 12 and the vertical ribs 6*a* and horizontal ribs and, as shown in FIG. 3, the inclined sides 11*a* of the inclined ribs 11 are exposed sideways above the fork inserting portions 4. When multiple synthetic resin pallets are piled up, therefore, it is easy to insert the fork of a forklift between the multiple stacked synthetic resin pallets using the inclined ribs 11 as a guide and it is possible to easily separate the multiple stacked synthetic resin pallets.

Second Embodiment

Figure 7:
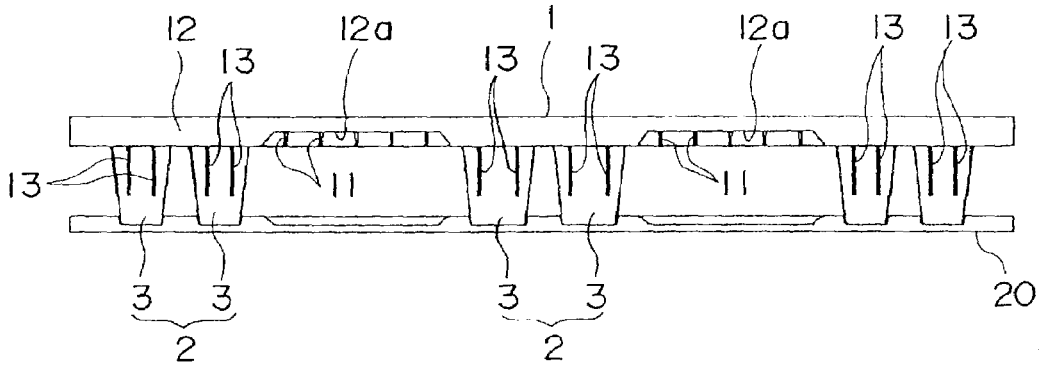
FIG. 7 is a front view illustrating a second embodiment of a synthetic resin pallet of this invention.
Figure 8:
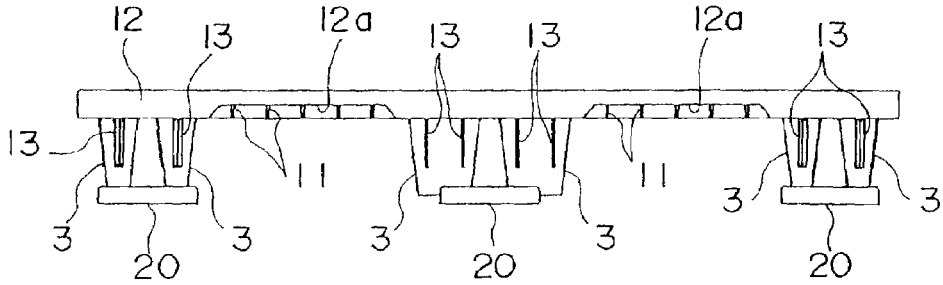
FIG. 8 is a side view of the synthetic resin pallet shown in FIG. 7.
Figure 9:
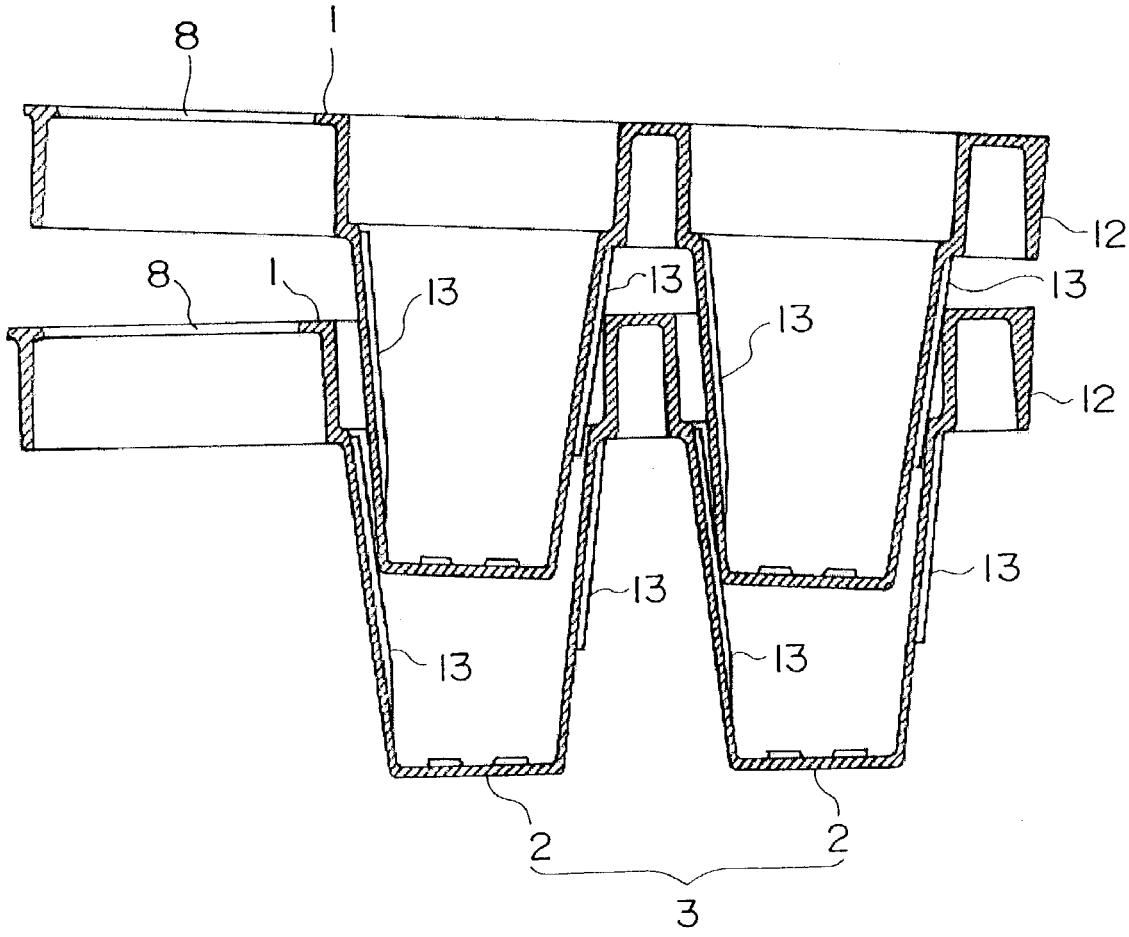
FIG. 9 is a partially cross-sectional view showing the synthetic resin pallets shown in FIG. 1 stacked.

FIGS. 7 through 9 illustrate a second embodiment of this invention. In this second embodiment, to ensure easier pickup of stacked pallets, ribs 13 extending upward and downward are formed inside and/or outside the sides of the small leg portions 3.

It is preferable that at least one rib 13 be provided on the inside of the small leg portions 3 of an underlying pallet which the bottom portions of the small leg portions 3 of an overlying pallet contact, with the pallets piled up. The formation of such ribs 13 makes it easier to separate stacked pallets.

Those ribs 13 may be formed on both of the inside surface and the outside surface as well as only on the inside surface or only on the outside surface. When one rib 13 is formed on one side of the small leg portion 3, it is preferable that the rib 13 be so formed as to be positioned approximately the center portion of the side surface. When a plurality of ribs 13 are formed on one side, it is preferable that the ribs 13 be formed symmetrically at nearly equal intervals.

Although the width and height of the ribs 13 are not limited in this invention, it is preferable that they are approximately 0.5 to 1 mm. Further, the length and/or width of the ribs 13 may differ between the inside surface and the outside surface of the small leg portions 3.

This structure makes smaller the contact area of the small leg portions 3 when stacked pallets are to be picked up, thus reducing the contact resistance, so that it is possible to easily take out the pallets even in the case where a person works alone.

In this embodiment, as illustrated, plate-like link portions 20 may be fixed to the small leg portions 3. The plate-like link portions 20 may be the same as those of a third embodiment discussed below.

Third Embodiment

Figure 10:
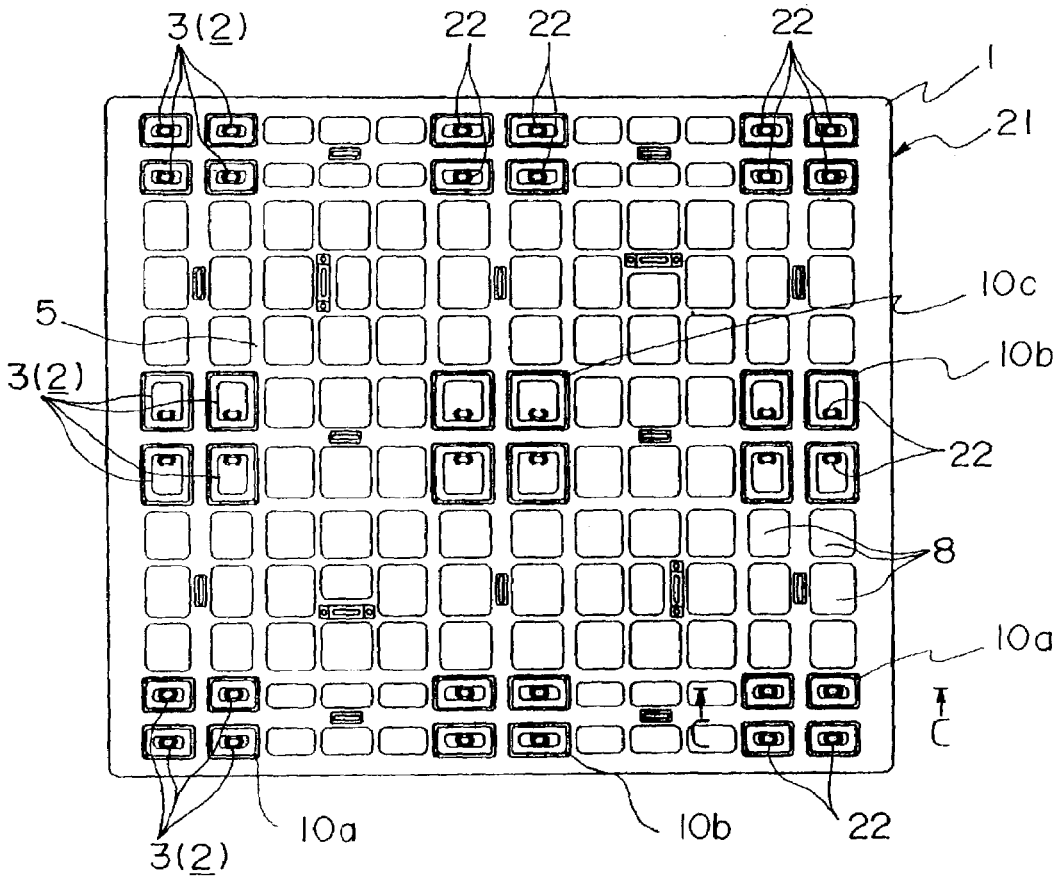
FIG. 10 is a plan view illustrating a third embodiment of a synthetic resin pallet according to this invention.
Figure 11:
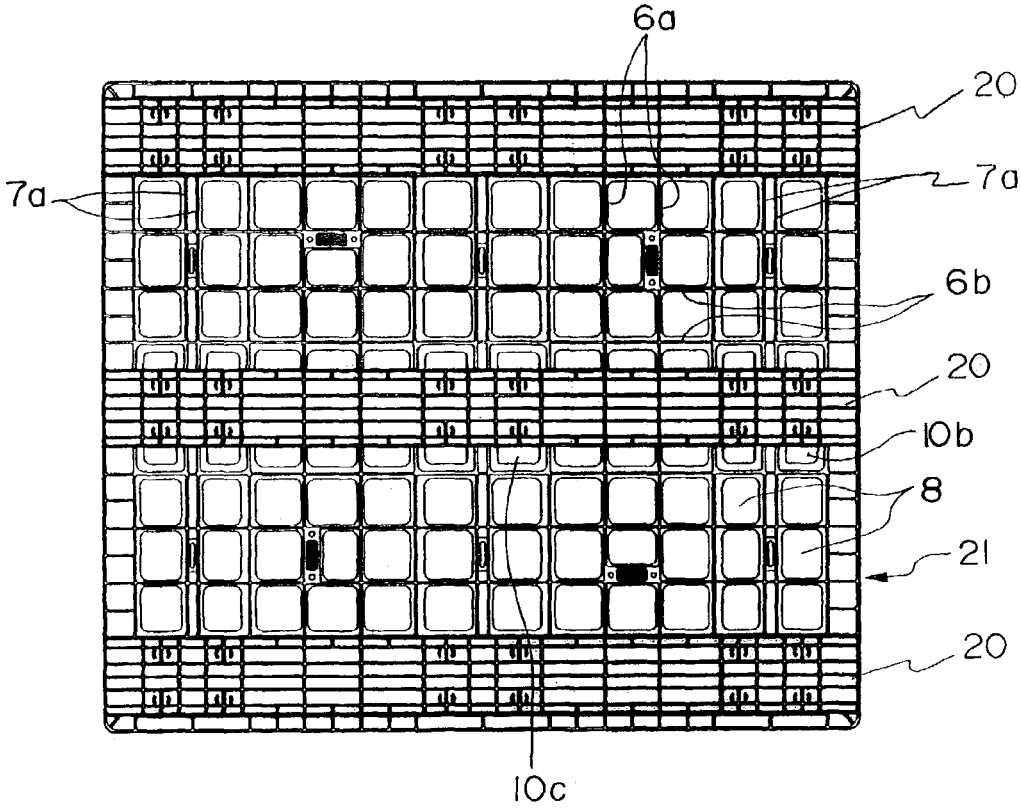
FIG. 11 is a bottom view of the synthetic resin pallet shown in FIG. 10.
Figure 12:
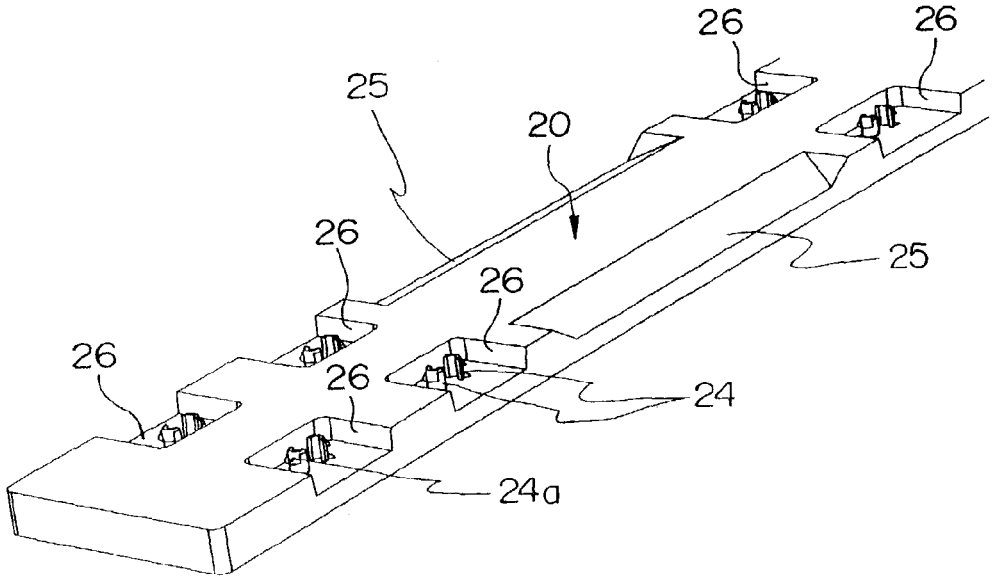
FIG. 12 is a partially perspective view showing a plate-like link portion in the embodiment in FIG. 10.
Figure 13:
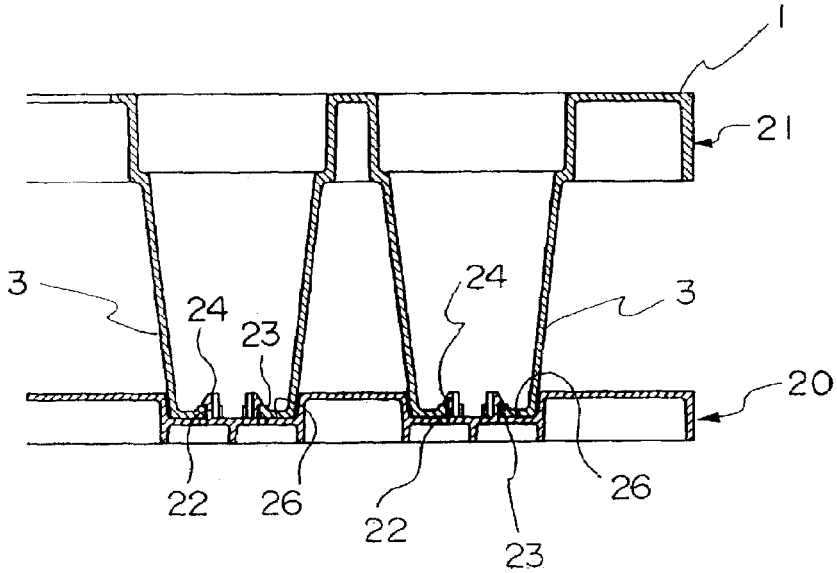
FIG. 13 is a partially cross-sectional view along the line C-C in FIG. 10.
Figure 14:
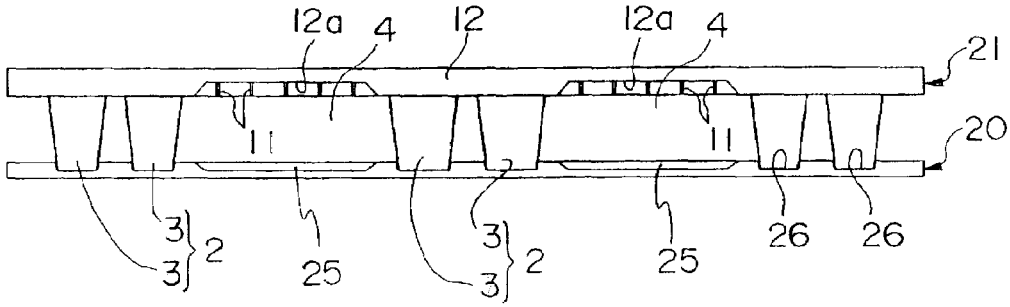
FIG. 14 is a front view of the synthetic resin pallet shown in FIG. 10.
Figure 15:
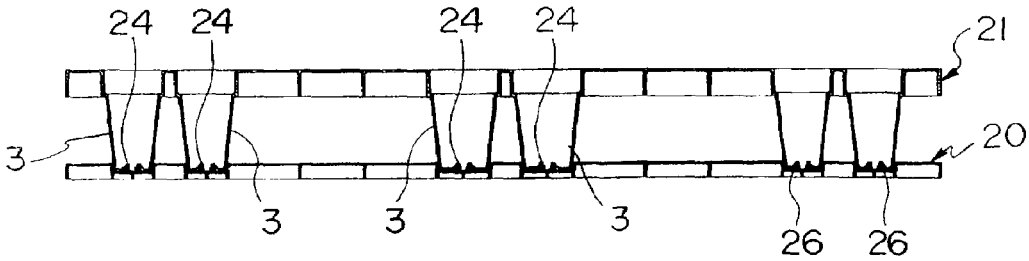
FIG. 15 is a cross-sectional view of the synthetic resin pallet shown in FIG. 10.

FIGS. 10 through 15 illustrate a third embodiment of a synthetic resin pallet according to this invention, and same reference numerals are given to those portions which are common to the previous embodiments to omit their description. The synthetic resin pallet of this embodiment comprises a pallet body 21 and plate-like link portions 20 of a synthetic resin which are detachably attached to the bottoms of the leg portions 2 of the pallet body 21. FIGS. 10 and 11 are a plan view and a bottom view of this synthetic resin pallet, FIG. 12 is a partially perspective view showing the plate-like link portion 20, FIG. 13 is an enlarged cross-sectional view along the line C-C in FIG. 10, FIG. 14 is a front view of the synthetic resin pallet and FIG. 15 is a cross-sectional view of the synthetic resin pallet.

In the pallet body 21, an engagement hole 22 of an elliptical shape or the like and a bank portion 23 protruding upward along the upper opening edge of the engagement hole 22 are formed at the bottom of each small leg portion 3 in order to detachably attach the plate-like link portions 20.

The entire length of the plate-like link portion of this embodiment is approximately equal to one side of the pallet body 21 as shown in FIG. 14, and the width of the plate-like link portion 20 corresponds to the width of each leg portion 2 as shown in FIG. 11. In this embodiment, therefore, three plate-like link portions 20 are attached to the pallet body 21. Those of the three plate-like link portions 20 which are on both sides have both end portions respectively fixed to the leg portions 2 at the four corner positions 10*a* of the pallet body 21, and the center one is fixed to the leg portions 2 at the intermediate positions 10*b* of the sides of the pallet body 21. Although the plate-like link portions 20 on the both sides and the center one have the same shape in this embodiment, their shapes may made different as needed.

A plurality of recesses (fitting portions) 26 in which the lower ends of the small leg portions 3 of the pallet body 1 are to be fitted are formed in the top surfaces of the plate-like link portions 20 on both widthwise sides (a total of twelve in this embodiment) as shown in FIG. 12. Those recesses 26 have three sides that abut on the side surfaces of the lower end the small leg portion 3, which is secured, by those three sides. In this embodiment, particularly, a total of four small leg portions 3 corresponding to each leg portion 2 are all fixed by the recesses 26, so that even when force is applied in any direction on a horizontal plane, the plate-like link portions 20 can be prevented from being inadvertently separated from the leg portions 2.

Engaging portions 24 are respectively formed at nearly the center portions of the bottoms of the recesses 26. The engagement portion 24 in this embodiment is a pair of approximately semicylindrical protrusions which are cut away by a slit extending perpendicularly as shown in FIG. 12, and a semiannular collar portion 24*a* so tapered as to become narrower upward is formed at the upper end of each protrusion. As the engagement portion 24 is fitted in the engagement hole 22 formed in the bottom of the small leg portion 3, therefore, the collar portion 24*a* engages with the bank portion 23 of the engagement hole 22 so that the engagement portion 24 does not come off the engagement hole 22 easily. The engagement portions 24 are not limited to the illustrated shape, but may be cylindrical. The number of the engagement portions 24 is not restrictive and three or more has only to be formed for each plate-like link portion 20; however, it is preferable that the number should be equal to the number of the facing small leg portions 3 as in this embodiment.

The plate-like link portions 20 can be detachably attached to the small leg portions 3 of the pallet body 21 by fitting the engagement portions 24 into the engagement holes 22 and engaging the collar portions 24*a* with the upper ends of the bank portions 23 as shown in FIG. 13. To attach the plate-like link portions 20 to the pallet body 21, for example, the pallet body 21 should be flipped over and put on a floor, the plate-like link portions 20 should be turned over and placed on the pallet body 21 with the engagement portions 24 placed over the engagement holes 22, the plate-like link portions 20 should be pressed downward, the engagement portions 24 should be moved downward in the engagement holes 22 while elastically narrowing the diameters of the engagement portions 24, and the collar portions 24*a* should be engaged with the upper ends of the bank portions 23.

To remove the plate-like link portions 20 from the pallet body 21, with those done reversely, for example, a hole of a pipe (unillustrated) should be put in contact with the collar portion 24*a* of the engagement portion 24, the pipe should be pressed downward to narrow the diameter of the engagement portion 24, thus removing the collar portion 24*a* from the upper end of the bank portion 23, and the plate-like link portion 20 should be lifted up from the pallet body 21 to disengage the engagement portion 24 from the engagement hole 22. It is preferable to prepare such a pipe as a removing tool.

It is preferable that inclined portions 25 should be formed between the recesses 26 as shown in FIG. 14. When such inclined portions 25 are formed, at the time the pallet body 21 to which the plate-like link portions 20 are secured is lifted up by a transporting machine, such as a hand lifter with wheels, the wheels easily roll over the plate-like link portions 20, thus making the transporting operation easier.

The synthetic resin pallet according to this invention or the synthetic resin pallet which has the pallet body 21 and the plate-like link portions 20 linked and integrated together can be manufactured by injection molding using a synthetic resin such as polyethylene or polypropylene. In this case, the pallet body 21 and the plate-like link portions 20 can be formed integrally and an additive, such as a coloring agent or a filler, may be added to the synthetic resin as needed.

The synthetic resin pallet of this embodiment can prevent the small leg portions 3 from hitting articles of an underlying pallet, damaging them, when multiple pallet bodies 21 on which articles are loaded are piled up by attaching the plate-like link portions 20 to the small leg portions 3 of the pallet bodies of the synthetic resin pallets. In the case where the pallet body 21 on which articles are placed is moved on a roller conveyor, the presence of the plate-like link portions 20 can prevent undesirable rattling vibration from occurring.

As the engagement portions 24 are fitted in the engagement holes 22 to secure the plate-like link portions 20 to the pallet body 21 in this embodiment, the bonding force can be increased. Even if a loading worker moves the pallet dragging on the floor with the plate-like link portions 20 attached to the pallet body 21, therefore, the plate-like link portions 20 do not unintentionally come off the pallet body 21.

INDUSTRIAL APPLICABILITY

As the synthetic resin pallet of this invention has a sufficient strength, the pallet does not bend even when a heavy article is placed thereon, making it possible to prevent the articles from falling or the pallet from being damaged. Even if the pallet is dragged on the floor by a loading worker or the like with the plate-like link portions attached to the leg portions of the pallet body, the plate-like link portions do not unintentionally come off. It is therefore possible to improve the reliability of the loading work.

What is claimed is:

1. A synthetic resin pallet having a load portion and a plurality of leg portions protruding downward from said load portion with fork inserting portions provided between said leg portions, wherein said load portion comprises a horizontal plate portion and a grating portion formed by intersection of a plurality of vertical ribs extending vertically and a plurality of horizontal ribs extending horizontally, provided at a bottom of said horizontal plate portion, and said leg portions are so formed as to protrude downward from a lower end of said grating portion, and each of said leg portions comprises a plurality of small leg portions which are separated by a plurality of parallel said vertical ribs and/or a plurality of parallel said horizontal ribs, and said vertical ribs comprises first vertical ribs that are not crossing said leg portions and second vertical ribs that are crossing said leg portions, and said horizontal ribs comprises first horizontal ribs that are not crossing said leg portions and second horizontal ribs that are crossing said leg portions, and between a plurality of said small leg portions which constitute the same said leg portion, a plurality of parallel said second vertical ribs, formed at an interval narrower than an interval of said first vertical ribs, and/or a plurality of parallel said second horizontal ribs, formed at an interval narrower than an interval of said first horizontal ribs, are formed.

2. The synthetic resin pallet according to claim 1, wherein engagement portion inserting holes are formed in bottoms of at least some of said small leg portions.

3. The synthetic resin pallet according to claim 1, wherein said small leg portions are hollow with bottoms.

4. The synthetic resin pallet according to claim 1, wherein said small leg portions are formed to be hollow with bottoms and have tapered shapes which become wider upward.

5. The synthetic resin pallet according to claim 1, wherein a perpendicular portion extending downward is formed around said load portion, a plurality of inclined ribs having inclined sides inclined downward are formed between said perpendicular portion and those vertical ribs and horizontal ribs which extend in parallel along inside said perpendicular portion, and said inclined sides of said inclined ribs are exposed sideways at positions corresponding to said fork inserting portions.

6. The synthetic resin pallet according to claim 1 further comprising, as said leg portions, leg portions so provided as to protrude downward from corner positions of said load portion, leg portions so provided as to protrude downward from intermediate positions of a periphery of said load portion, and leg portions so provided as to protrude downward from a center portion of said load portion.

7. The synthetic resin pallet according to claim 1, further comprising plate-like link portions for linking said plurality of leg portions when detachably attached to lower ends of said small leg portions, wherein fitting portions which engage with lower end portions of some of said small leg portions are formed in said plate-like link portions.

8. The synthetic resin pallet according to claim 7, wherein recesses in which lower ends of said small leg portions are to be fitted are formed in said plate-like link portions as said fitting portions.

9. The synthetic resin pallet according to claim 1, wherein ribs extending upward and downward are formed on outsides of said small leg portions.

* * * * *